US005162050A

United States Patent [19]

Knudson et al.

[11] Patent Number: 5,162,050

[45] Date of Patent: * Nov. 10, 1992

[54] LOW-RANK COAL OIL AGGLOMERATION PRODUCT AND PROCESS

[75] Inventors: Curtis L. Knudson; Ronald C. Timpe, both of Grand Forks, N. Dak.; Todd A. Potas, Plymouth, Minn.; Raymond A. DeWall; Mark A. Musich, both of Grand Forks, N. Dak.

[73] Assignee: University of North Dakota School of Engineering & Mines Foundation (UND-SEM Foundation), Grand Forks, N. Dak.

[ * ] Notice: The portion of the term of this patent subsequent to Jul. 16, 2008 has been disclaimed.

[21] Appl. No.: 729,461

[22] Filed: Jul. 12, 1991

Related U.S. Application Data

[63] Continuation-in-part of Ser. No. 414,536, Sep. 28, 1989, Pat. No. 5,032,146.

[51] Int. Cl.[5] ..... C01L 5/02

[52] U.S. Cl. ..... 44/592; 44/608; 44/626; 44/627

[58] Field of Search ..... 44/592, 608, 626, 627

[56] References Cited

U.S. PATENT DOCUMENTS

| | | | |
|---|---|---|---|
| 4,282,004 | 8/1981 | Masologites | 44/1 |
| 4,284,413 | 8/1981 | Capes et al. | 44/280 |
| 4,726,810 | 2/1988 | Ignasiak | 44/280 |
| 4,854,940 | 8/1989 | Janiak et al. | 44/620 |
| 4,874,393 | 10/1989 | Mikhlin et al. | 44/20 |
| 5,032,146 | 7/1991 | Knudson et al. | 44/592 |

OTHER PUBLICATIONS

Ikura et al., "Selective Oil Agglomeration of Lignite Using Vacuum Bottoms Only as an Integral Part of Coprocessing", *Energy & Fuels,* 1989, 3, 132-136.

Szladow and Chan, "Kinetics of Heavy Oil/Coal Co-processing", *Energy & Fuels,* 1989, 3, 136.

*Primary Examiner*—Margaret Medley

*Attorney, Agent, or Firm*—Zarley, McKee, Thomte, Voorhees & Sease

[57] ABSTRACT

A selectively-sized, raw, low-rank coal is processed to produce a low ash and relative water-free agglomerate with an enhanced heating value and a hardness sufficient to produce a non-decrepitating, shippable fuel. The low-rank coal is treated, under high shear conditions, in the first stage to cause ash reduction and subsequent surface modification which is necessary to facilitate agglomerate formation. In the second stage the treated low-rank coal is contacted with bridging and binding oils under low shear conditions to produce agglomerates of selected size. The bridging and binding oils may be coal or petroleum derived. The process incorporates a thermal deoiling step whereby the bridging oil may be completely or partially recovered from the agglomerate; whereas, partial recovery of the bridging oil functions to leave as an agglomerate binder, the heavy constituents of the bridging oil. The recovered oil is suitable for recycling to the agglomeration step or can serve as a value-added product.

7 Claims, No Drawings

LOW-RANK COAL OIL AGGLOMERATION PRODUCT AND PROCESS

GRANT REFERENCE

This invention was made with Government support under contract No. DE-FC21-86MC10637 awarded by the Department of Energy. The Government has certain rights in this invention.

REFERENCE TO A RELATED APPLICATION

This application is a continuation-in-part of application Ser. No. 414,536 filed Sep. 28, 1989, now U.S. Pat. No. 5,032,146 issued Jul. 16, 1991.

BACKGROUND OF THE INVENTION

Research into the oil agglomeration of bituminous coals as a means of beneficiation has been very successful. However, transfer of this technology to low-rank coals has proven difficult. Put another way, low-rank coals, that is coals which contain inherent and particulate ash and are high in moisture content are very difficult to agglomerate. This is important because much of the available coal resources in this country are surface mined lignite and subbituminous (low-rank) coals. These are particularly known to be high in organic salt content and high in mineral content, high moisture, and some are high in sulfur. They also burn less efficiently, and may cause ash fouling of boilers and may cause more undesirable emissions.

Nevertheless, the dwindling petroleum reserves and OPEC control of the petroleum economy in the past two decades has rekindled interest, worldwide, in coal as a source of energy. The return to emphasis on coal utilization after several decades of a petroleum energy base has begun to impact the world's supply of high quality, easily mined, low-ash coal. Mineral matter (including organic salts), and sulfur and water content are three of the major concerns with the increased use of coal as a utility fuel or as a feedstock for conversion processes. Their presence in the coal impacts ash handling and disposal, $SO_x$ and $NO_x$ emissions, fly ash and ash fouling, calorific value of the fuel, transportation costs, and the reactivity of the feedstock. Substantial upgrading of the coal would result from its demineralization and dewatering. Finding new, more efficient methods of beneficiation of coals has therefore become a priority in coal research.

Among the most widely used methods of fine coal beneficiation at present is froth flotation. Although the technique works quite well with higher rank coals and fines with larger particle sizes and low ash, it does have some drawbacks. Among its shortcomings are a comparatively low yield of beneficiated product with a high moisture content when fines are less than 6 μm. As mined, coals and coals with oxidized surfaces are not amenable to beneficiation by flotation.

Agglomeration studies of lignite and subbituminous (low-rank) coals have not met with a great deal of success primarily because the experiments have centered around the successful techniques used to agglomerate bituminous coal. Since agglomeration is a surface phenomenon, the binding oil selected to form the aggregates of fines must be compatible with the surface functional groups on the fines. Subbituminous and lignite coals contain large amounts of surface oxygen organic salts, minerals and water making their surfaces less oleophilic than the surfaces of bituminous coals.

Most oils used for agglomeration are not highly polar and as a result are readily adsorbed to the organic surface of the coal particles, provided they have minimal surface polar groups and surface water. These characteristics apply to bituminous coals but not to lower rank coals. Since the theory of agglomeration assumes mineral material is considerably more hydrophilic and olephobic than the organic coal matrix, the mineral material will dissolve or form a suspension in an aqueous medium and the organic matter, upon mixing with a limited amount of oil, will form aggregates and separate from that phase. Again, this is more easily accomplished with aliphatic binding oils for the coals of higher rank than for those of lower rank.

It can therefore be seen that there is a continuing and real need for the development of coal beneficiation processes which can be used with low-rank coal. Moreover, there is a continuing need for processes which are cost effective, provide agglomerates which are nonpolluting, and which in fact beneficiate the low-rank coal.

The process of the earlier cross-referenced Knudson and Timpe invention had as its primary objective the fulfillment of the above need. In particular, the development of an economical low-rank coal beneficiation process, which could be successfully performed and which would reduce the polluting effect of the coal, as well as the salt content, mineral content and moisture content, such that it can be more efficiently used. This was accomplished with a particular coal derived oil for agglomeration of low-rank coals. The process of the present invention continues to improve on this earlier process with a series of further process steps to further beneficiate low-rank coals.

The series of additional process steps of the present invention improve the economics of use of low-rank coal, improve the economics of the coal processing, and enhance the low ash, low moisture aspects of the agglomerated product.

The most important objective of the present invention is to continue the development of low-rank coal as an alternative to oil which can be efficiently used without pollution problems.

The method and manner of accomplishing the above objective as well as others will become apparent from the detailed description of the invention which follows hereinafter.

SUMMARY OF THE INVENTION

In accordance with the process of this invention, lignite and/or subbituminous coals are size-reduced under high shear conditions to cause ash reduction and surface modification,, the pH is adjusted to five or less, the particles are thereafter mixed with from about 20% by weight to about 50% by weight of a bridging oil which is at least partially water soluble and capable of entering the pore structure of the coal, and which is preferably derived from coal itself, and has a hydroxyl content of greater than 15 wt. percent. The oil and the particles are blended, mixed, agglomerated, and thereafter dried. A binding oil is preferably used with the bridging oil and the bridging oil partially recovered by thermal means.

DETAILED DESCRIPTION OF THE INVENTION

To meet the requirements of successful agglomeration, the mineral content of a coal should be reduced significantly as the coal forms aggregates of organic-rich material, while additional ash removal occurs by removal of salts by ion exchange. The degree to which a coal can be beneficiated by agglomeration is limited by several factors. The first is the particle size. Liberation of minerals depends largely on their surface exposure to liberating media. The effect that particle size has on the liberation is easily understood when one considers the mode of emplacement of minerals into the coal. Mineral particles, which are typically nonuniform in size and widely dispersed in the coal, were incorporated into the organic matrix by one or more of three methods: (1) Minerals inherent to the living vegetation were laid down with the organic plant material as it ended its life cycle; (2) Detrital material was entrapped as the generations of original plant material accumulated; and, (3) Chemical solutions deposited mineral material from saturated water solutions. In addition, organic salts are present in the coal which can ion exchange with ions in surrounding water.

The lower the pH the more salts are removed by ion exchange. The finer the particle size, the more contact that can occur between the liquid and the widely dispersed minerals, and, consequently, the better the chances of the carbonaceous material liberating its associated minerals, thus lowering ash content. Although fine grinding enhances inorganics removal, it may create problems in handling the cleaned product and provides more area for undesirable surface oxidation. Effective agglomeration following ash reduction helps to solve these problems. The improved process of the present invention can use as large as 30 mesh particle size and still achieve good agglomerates, thus creating an energy savings.

A second factor to be considered is the composition of the oil used as a binder. Light agglomerating oils (density $<0.90$ g/cc) have been shown to give ash reductions in bituminous coals within 10 to 20 percent of those obtained with Stoddard solvent. These oils, however, do not wet the surface of low-rank coals well, and are not useful as binding oils for these coals. If heavier oils such as coke oven tars, pitches, and petroleum crudes are used, low-rank coals can be agglomerated, but with little ash and moisture reduction and the recovery of these oils from agglomerates requires rigorous treatment, which translates to added cost.

In accordance with the process of this invention in a first step, the coal particles of the low-rank coal are size reduced under high shear conditions to cause ash reduction and surface modification. In the size reduction step, particles should be size reduced such that they will pass through a 30 mesh standard U.S. sieve screen (combustion grind) where standard size reduction high shear techniques may be employed such as a standard hammer mill. If desired, the particles may be ground to 60 mesh or even a micro grind size of from about 10 to about 20 microns with special equipment. However, one of the advantages here is the ability to achieve good results with larger particles, i.e. 30 mesh.

After size reduction, in accordance with the process of this invention it has been found necessary to adjust the pH of the size reduced particles to 5 or less, and preferably to 3 or less and even as low as 1, depending on the degree of ash removal desired. The pH adjustment may be with any useful acid such as sulfuric acid, hydrochloric acid, nitric acid, and even carbonic acid. The importance of the pH adjustment is to allow removal of carboxylic acid salts with the mineral phase, especially sodium salts of carboxylic acids.

Most preferably the pH is adjusted to 5 or less, preferably 3 or less, and best results are seen at highly acid pH conditions of 1. The lower the pH the more efficiently sodium ions ($Na^+$) and calcium ions ($Ca^{++}$) are removed.

After the pH adjusting acid is added, usually in an aqueous system, the coal/acid slurry is mixed, at from about 100 rpms to about 1500 rpms on a conventional high shear mixer, for anywhere from 10 minutes to about 30 minutes.

After the pH reduction, the particles are mixed with from about 20% by weight to about 50% by weight of the bridging oil, and from about 3% to about 12% of a binding oil, preferably from 3% to 9% of a binding oil. The bridging oil must be a polar organic solvent which is at least partially water soluble and capable of entering the coal pore structure. Usually, and in most cases preferably, the bridging oil itself is coal-derived. It can be successfully derived from coal gasification plants and coal pyrolysis processing. In coal gasification plants two of the oil streams which can be used to provide the most highly preferred coal-derived bridging oil are the crude phenolic stream and the crude coal tar stream. The phenolic stream can be the crude phenolic stream which has a predominate amount of phenol and cresol present. Likewise, the crude coal tar derived stream has a predominant amount of cresol and polar aromatics present. There is also present a certain amount of cresylic acid in the cresol tar stream which functions as a surfactant, coating the coal surface and entering the coal structure to expel water from the pores. The oil or hydrophobic portion of the bridging oil accumulates on the surface and bridges to other coal particles. As a result, the bridging oil of this invention is far superior to the oils (such as petroleum based oils) used in conventional oil agglomeration processing.

Preferably the bridging oil is up to about 40% by weight of the particles, and it preferably has a predominant amount of phenol, cresol or other polar component with a hydroxyl content of greater than 15 wt. percent. After the oil addition, there is continual mixing under low shear conditions until there is substantial homogeneity. Typical mixing is for from about 2 minutes to about 15 minutes, preferably from about 3 minutes to about 10 minutes at mixing speeds of from 300 rpm to 900 rpm, with 300 rpm being satisfactory.

The binding oil may also be coal derived but does not have to be coal derived. It represents a heavier fraction than the bridging oil, generally those that remain after a thermal recovery process which heats to 240° C. These heavier fractions will remain to harden and stabilize the agglomerates and prevent dustiness, moisture reabsorption and spontaneous combustion during transportation, handling and use.

If desired to add additional surfactant, one may add a surfactant to the system such as nonionic surfactants, for example Triton X-100®. These nonionic surfactants are not necessarily needed if the oil is a coal-derived oil, but may be used if desired. Where a surfactant, that is a nonionic surfactant is used, it is used at a level of from about 1% by weight to about 5% by weight of the coal particles, preferably from about 1% by weight to about 3% by weight of the coal particles. An adequate surfactant can be derived by distillation of the phenol and cresol fractions from coal liquids and used in conjunction with the bottoms.

After mixing, particles will be agglomerated, typically in a ball mill. Agglomerating conditions are typical and merely involve blending of the materials together until the agglomerates are of uniform size. This may take from 5 to 30 minutes. Typically the agglomerates will have greater than 30 mesh size. The agglomerates are screened to remove ash and water and are then air dried. They may also be thermally dried at temperatures of 240° C. or below to allow bridging oil recovery and to leave only binding oil.

The polar, coal-derived, phenolic oils used for the bridging liquid during oil agglomeration of the low-rank coals are less polar than water. Therefore, they displace the water in the agglomerated coal. After thermal recovery of the oil the agglomerates are left virtually moisture-free with 3% to 7% oil remaining as a binder. This leaves the hydrophobic, inert binder on the exterior of agglomerates, avoiding the problems of dustiness, spontaneous combustion and moisture reabsorption usually associated with thermal drying.

Thermal recovery of the bridging liquid can be accomplished from the agglomerates at temperatures of 240° C. or below for recycle of the bridging oil. In this step the agglomerates are simply heated to the desired thermal recovery temperature (i.e. 240° C.) and the vapors collected and condensed for recycle use.

After the bridging liquid has made one pass through the agglomeration procedure the oil is purified by depositing heavy oil components on the coal as a binder with the coal serving as an absorbant. The purified bridging oil can be used for recycle or by-product sales.

The bridging and binding oils can be coal-derived by-products produced during coal gasification. Oils used to date were produced at the Great Plains Coal Gasification Plant (now the Dakota Gas Co.). Recently investigated mild gasification processes have oil by-products, which also show good potential for this technique.

The agglomerates are suitable for briquetting or pelletizing due to the presence of 3% to 7% binding oil on the agglomerates after the thermal step.

The processes herein described of successful agglomeration of low cost lignite and subbituminous coal provides agglomerates which for the first time have potential significant commercial possibilities for low-rank coals. For example, these agglomerates represent products prepared from low-rank coal which have the following attributes: (1) lower transport costs (higher Btu/lb) and potential slurry pipeline applications; (2) reduction in dust explosions and environmental pollution due to less fines; (3) higher recovery following crushing (fines can be agglomerated); (4) reduced pyrophoric properties resulting in safe transport and storage; (5) higher boiler capacity due to higher Btu/lb; (6) less ash fouling of boiler (higher on line time and less maintenance costs, due to less ash and less sodium in the ash); (7) less ash handling and disposal at the utility site; and (8) lower sulfur emissions.

For coal conversion, there also are significant benefits. In particular, the following attributes are achieved: (1) less oxidation and loss of reactivity during preparation and storage; (2) decreased crushing costs due to a softening of the coal; (3) decreased drying costs due to rejection of moisture at ambient conditions; (4) decreased catalyst deactivation due to the elimination of ion exchangeable cations and lower hydrogen consumption due to less sulfur; (5) higher through put due to less ash and water in the feed; (6) a lower ash content resulting in lower liquid losses due to adsorption in a critical solvent deashing unit; and, (7) up-grading of previous coal conversion reject streams.

The following examples are offered to further illustrate but not limit the process of the present invention.

EXAMPLES

A successful study of a potential process to produce low-ash and low-moisture content oil agglomerates from low-rank coals was carried out at the University of North Dakota Energy and Environmental Research Center. The tests were successful in agglomerating a lignite with additives and a coal-derived crude phenolic binding oil at ambient conditions. Up to three-fourths of coal ash and moisture was removed with coal recoveries of 90% as agglomerates. Repeat tests have yielded agglomerates with ash contents as low as 0.7 weight percent. Particle size of the agglomerates varies as a function of agglomerating conditions and has only a slight effect on ash content.

The tests used laboratory equipment operating at ambient conditions with micronized coal (100% minus 325 mesh), additives, coal-derived oil and water. The agglomerates were collected on 30 mesh screen, washed with deionized water, and air-dried at least overnight. Analysis of the agglomerates was on Thermogravimetric Analysis (TGA) equipment using a TGA Proximate Analysis methodology. To ensure the accuracy of the results, selected samples including the feed coal were analyzed using ASTM method D3172. Table 1 shows the proximate analysis of the feed coal as determined by both the TGA and the ASTM methods. Table 2 shows TGA and ASTM results for agglomerates obtained using three different sets of test conditions.

Table 3 summarizes the results of agglomeration tests carried out under three sets of experimental conditions with the Zap Indian Head lignite and coal-derived binding oil. Excellent ash reduction of 73% and moisture reduction of 77% was obtained at ambient conditions with simple equipment. The 92% coal recovery shown was not atypical of recoveries in the testing where Condition 2 was used. Reject did not collect on the screen but was recoverable as a fine coal. Ash and moisture reduction and coal recovery were equalled or improved with repeat testing.

TABLE 1

TGA AND ASTM PROXIMATE ANALYSES OF ZAP INDIAN HEAD LIGNITE

| | TGA[a] wt % | ASTM D3172 wt % | Difference % |
|---|---|---|---|
| Volatile Matter, mf | 45.51 | 47.14 | 3.4 |
| Fixed Carbon, mf | 46.39 | 48.04 | 3.4 |
| Ash, mf | 7.82 | 7.74 | −1.1 |
| Moisture, AR | 24.78 | 25.38 | 2.4 |

[a]Average of three analyses

TABLE 2

ASH REDUCTION AS MEASURED BY ASTM AND TGA METHODS

| | ASTM D3172 Results | | | TGA Results | | |
|---|---|---|---|---|---|---|
| Condition | 1 | 2 | 3 | 1 | 2 | 3 |
| Volatiles, mf | 59.58 | 64.54 | 63.12 | 59.71 | 64.02 | 62.83 |

TABLE 2-continued

ASH REDUCTION AS MEASURED BY ASTM AND TGA METHODS

| Condition | ASTM D3172 Results 1 | 2 | 3 | TGA Results 1 | 2 | 3 |
|---|---|---|---|---|---|---|
| Fixed Carbon, mf | 36.04 | 34.17 | 34.53 | 36.11 | 33.89 | 34.37 |
| Ash, mf | 4.38 | 1.29 | 2.35 | 4.10 | 1.76 | 2.55 |
| Moisture, AR | 8.19 | 19.59 | 13.48 | 5.80 | 13.90 | 11.03 |
| mf and oil free | | | | | | |
| Volatiles | 46.89 | 49.04 | 48.26 | 47.07 | 48.69 | 48.11 |
| Fixed Carbon | 47.59 | 49.53 | 48.80 | 47.77 | 49.17 | 48.65 |
| Ash | 5.53 | 1.43 | 2.94 | 5.16 | 2.14 | 3.24 |

TABLE 3

RESULTS OF OIL AGGLOMERATION OF ZAP INDIAN HEAD LIGNITE

| CONDITION | 4 | 2 | 5 | Reject[a] |
|---|---|---|---|---|
| Ash Reduction[b], % | 34.2 | 72.8 | 58.7 | 59.6 |
| Moisture Reduction, % | 76.6 | 43.9 | 55.5 | 73.8 |
| Coal Recovery, % | 74 | 92 | 79 | — |

[a]Reject was minus 595 micron material produced under test condition 2.
[b]Wt % on a moisture-free, oil-free basis.

The agglomeration of low-rank coal in this study was achieved at ambient conditions using very low speed blending and mixing. The binding oil was the unrefined crude phenol coal-derived material (90 GC area percent being phenol, creosols and xylenols, with no other component making up more than 1 GC area percent) is such that at present, it has only fuel value.

Agglomerates approximated spheres with diameters ranging from 1 to 25 mm; sizes were controlled by varying mixing time and component ratios. With extended mixing times, small agglomerates tended to aggregate, forming larger agglomerates. Larger agglomerates tended to have slightly higher ash and moisture contents, probably due to occlusion of dissolved salt during agglomerate growth.

In all cases, air drying at ambient temperature was used to remove moisture. It is apparent that little is accomplished by drying in excess of 24 hours at these conditions.

The improved process here described is tailored to reduce the ash and moisture levels in lignite and subbituminous coals and is economically attractive. The process is conducted at ambient conditions, except for a low-temperature recovery step for the agglomerating oils. The product agglomerates are clean, low-moisture, solid coal fuel, which can be transported by rail. They have shown no tendency to be dusty, prone to spontaneous combustion or moisture reabsorption, but are a hard, stable agglomerate at a manageable size. Agglomerates with 1.5 wt. percent ash and moisture contents of less than 1% on a dry basis have been produced with over 80% weight recovery from high ash (10%) and high moisture (35%) raw North Dakota lignite by this technique. Oil consumption in the process has been reduced to less than 7 wt. percent for binding the agglomerates and the as-received heating values are over 11,500 Btu/lb.

Due to the high as-received agglomerate heating values of 11,000 to 12,000 Btu/lb, transportation costs for the agglomerates is reduced by 33% for subbituminous and up to 50% for lignite compared to the cost for rail transport of the asmined, raw coals. In addition, these fuels can be used for high-valued fuel applications usually reserved for expensive, low-sulfur, high Btu Eastern bituminous coals or petroleum coke. This creates an expanded market for low-sulfur western coals, which is important considering recently established emissions limits for $SO_2$.

There have been no low-rank coals tested to date that have not been successfully upgraded by this agglomeration technique. This is an extremely important point when considering the dewatering and cleaning potential for lignites and brown coals in Eastern European countries, where these coals are abundant, but difficult to utilize in the as-mined form. Since the low-ash, low-sulfur agglomerates have a binding oil present, it may be possible to briquette or pelletize the agglomerates into a 0.5 to 1 inch fuel, which would be suitable for residential, commercial and light industrial heating markets as fuel substitutes for oil and natural gas.

It therefore can be seen that the improved process accomplishes all of its stated objectives.

What is claimed is:

1. A method of producing low ash, low moisture, low-rank coal agglomerates, comprising:
   (a) size-reducing coal particles to a size that passes through a 30 mesh standard sieve screen;
   (b) adjusting the pH of said particles to 5 or less;
   (c) mixing said size-reduced particles with from about 20% by weight to about 50% by weight of said coal particles of a coal derived unprocessed bridging oil which is a polar organic solvent at least partially water soluble and capable of entering the pore structure of the coal and from about 3% by weight to about 12% by weight of said coal particles of a coal derived binding oil fraction that remains undistilled after heating to 240° C. to recover higher boiling fractions.
   (d) agglomerating the size reduced particles; and
   (e) thermally recovering bridging oil from the formed agglomerates while leaving a portion of the binding oil on the agglomerates.

2. The method of claim 1 wherein the bridging oil is up to about 40% by weight of said coal particles.

3. The method of claim 1 wherein the binding oil is up to about 9% by weight of said coal particles.

4. The process of claim 1 wherein the pH is adjusted to 3 or less.

5. The process of claim 4 wherein the pH is adjusted to 1 or less.

6. The method of claim 1 wherein the bridging oil has a predominant amount of phenol, cresol or other polar component with a hydroxyl content of greater than 15% by weight.

7. The process of claim 1 wherein the process of thermal recovery is run until the binding oil content of the agglomerates is within the range of from abut 3% to about 7% by weight.

* * * * *